US009937501B2

(12) United States Patent
Andersson et al.

(10) Patent No.: US 9,937,501 B2
(45) Date of Patent: Apr. 10, 2018

(54) GYRATORY CRUSHER OUTER CRUSHING SHELL AND SEALING RING ASSEMBLY

(71) Applicant: SANDVIK INTELLECTUAL PROPERTY AB, Sanviken (SE)

(72) Inventors: Joel Andersson, Malmo (SE); Henrik Steede, Furulund (SE); Jan Johansson, Lomma (SE); Mikael Lindberg, Svedala (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 84 days.

(21) Appl. No.: 14/901,117

(22) PCT Filed: May 19, 2014

(86) PCT No.: PCT/EP2014/060244
§ 371 (c)(1),
(2) Date: Dec. 28, 2015

(87) PCT Pub. No.: WO2015/000626
PCT Pub. Date: Jan. 8, 2015

(65) Prior Publication Data

US 2016/0129448 A1 May 12, 2016

(30) Foreign Application Priority Data

Jul. 4, 2013 (EP) ..... 13175060

(51) Int. Cl.
*B02C 2/00* (2006.01)
*B02C 2/04* (2006.01)

(52) U.S. Cl.
CPC ..... *B02C 2/005* (2013.01); *B02C 2/04* (2013.01)

(58) Field of Classification Search
CPC ..... B02C 2/005; B02C 2/04
USPC ..... 241/207–216
See application file for complete search history.

(56) References Cited

U.S. PATENT DOCUMENTS

| | | | | |
|---|---|---|---|---|
| 1,791,584 A | | 2/1931 | Symons | |
| 2,110,276 A | | 3/1938 | Rumpel | |
| 2,970,775 A | | 2/1961 | Everett | |
| 2,971,705 A | | 2/1961 | Ewald | |
| 4,198,003 A | * | 4/1980 | Polzin | B02C 2/045 241/215 |
| 4,454,994 A | | 6/1984 | Johnson et al. | |
| 5,769,340 A | | 6/1998 | Jean | |
| 6,007,009 A | | 12/1999 | Sheridan et al. | |

(Continued)

FOREIGN PATENT DOCUMENTS

| | | |
|---|---|---|
| DE | 1507614 B1 | 11/1969 |
| GB | 1570015 A | 6/1980 |

(Continued)

*Primary Examiner* — Faye Francis
(74) *Attorney, Agent, or Firm* — Corinne R. Gorski

(57) ABSTRACT

A gyratory crusher outer crushing shell and a crushing shell assembly. The crushing shell includes a radially inward facing crushing surface and a radially outward facing mount surface provided with radially outward projecting contact regions to contact the topshell or an intermediate spacer ring. A ledge or groove providing an abutment face is positioned at or axially above the upper contact region to positionally support a sealing ring for positioning between the crushing shell and the topshell or intermediate spacer ring.

13 Claims, 9 Drawing Sheets

(56) References Cited

U.S. PATENT DOCUMENTS

| | | | |
|---|---|---|---|
| 6,536,693 | B2 | 3/2003 | Van Mullen et al. |
| 2005/0156070 | A1 | 7/2005 | Olsson et al. |
| 2009/0008489 | A1 | 1/2009 | Nieminen et al. |

FOREIGN PATENT DOCUMENTS

| | | | |
|---|---|---|---|
| JP | 2004136252 | A | 5/2004 |
| WO | 2004110626 | A1 | 12/2004 |
| WO | 2008140375 | A1 | 11/2008 |
| WO | 2010123431 | A1 | 10/2010 |
| WO | 2012005651 | A1 | 1/2012 |

* cited by examiner

GYRATORY CRUSHER OUTER CRUSHING SHELL AND SEALING RING ASSEMBLY

RELATED APPLICATION DATA

This application is a § 371 National Stage Application of PCT International Application No. PCT/EP2014/060244 filed May 19, 2014 claiming priority of EP Application No. 13175060.6, filed Jul. 4, 2013.

FIELD OF INVENTION

The present invention relates to a gyratory crusher outer crushing shell and in particular, although not exclusively, to a shell having a ledge positioned at an axially upper region of the shell to seat a sealing ring for positioning between the crushing shell and the topshell or an intermediate spacer ring.

BACKGROUND ART

Gyratory crushers are used for crushing ore, mineral and rock material to smaller sizes. Typically, the crusher comprises a crushing head mounted upon an elongate main shaft. A first crushing shell (typically referred to as a mantle) is mounted on the crushing head and a second crushing shell (typically referred to as a concave) is mounted on a frame such that the first and second crushing shells define together a crushing chamber through which the material to be crushed is passed. A driving device positioned at a lower region of the main shaft is configured to rotate an eccentric assembly positioned about the shaft to cause the crushing head to perform a gyratory pendulum movement and crush the material introduced in the crushing chamber. Example gyratory crushers are described in WO 2004/110626; WO 2008/140375, WO 2010/123431, US 2009/0008489, GB 1570015, U.S. Pat. No. 6,536,693, JP 2004-136252, U.S. Pat. No. 1,791,584 and WO 2012/005651.

Primary crushers are heavy-duty machines designed to process large material sizes of the order of one meter. Secondary and tertiary crushers are however intended to process relatively smaller feed materials typically of a size less than fifty centimeters. Cone crushers represent a subcategory of gyratory crushers and may be utilised as downstream crushers.

Typically, both the inner and outer crushing shells wear and distort due to the significant pressures and impact loading forces they transmit. In particular, it is common to use backing compounds to structurally reinforce the outer shell and assist with contact between the radially outward facing surface of the outer shell and the radially inward facing surface of the topshell. In particular, a backing compound (typically an epoxy or polyurethane material) is cured around the outer region of the concave to provide structural support to the concave during the crushing operation particularly in tough high-pressures applications involving, for example, processing extremely hard materials. Example backing compounds are available from ITW ('Korroflex') Ltd, Birkshaw UK under brand names Korrobond 65™ and 90™; and Monach Industrial Products (I) Pvt., Ltd, India, under brand name KrushMore™.

However, the majority of widely used backing compounds are disadvantageous for health and environmental reasons and require long curing times that extend the downtime of the crusher. Accordingly, there is a general preference to avoid their use. However, the backing material also has a further function to seal the region between the outer crushing shell and the topshell (or intermediate spacer ring) to prevent downward passage of debris particles and dust into the region between the crushing shell and the topshell which is undesirable. Accordingly, there is a need for an outer crushing shell configured for use without a backing compound whilst facilitating a means of sealing the radially outer region between the crushing shell and the topshell (or intermediate spacer ring) to prevent the ingress of contaminant particles and fines.

SUMMARY OF THE INVENTION

It is an objective of the present invention to provide an outer crushing shell, a topshell and crushing shell assembly and a sealing ring configured to prevent contaminant particles, such as stone and dust, from penetrating and damaging contact surfaces between the crushing shell, intermediate spacer ring and topshell. It is a further objective to provide a sealed assembly that is effective to prevent the ingress of contaminant material without the need for a backing compound positioned between the crushing shell, the spacer ring and/or topshell. It is a further objective to provide a sealing ring configured to be self-adapting and universal for different configurations of crushing shell for direct contact with the topshell or in contact with an intermediate spacer ring.

The objectives are achieve by providing an outer crushing shell specifically adapted to seat a sealing ring to be accommodated within a cavity region formed between the crushing shell and the radially outer topshell or intermediate spacer ring. In particular, the present crushing shell comprises an annular shoulder formed at an upper region of the shell wall that projects radially outward from the wall to define an annular ledge with an abutment face or seat region to support the sealing ring optionally via an underside surface. The annular shoulder is positioned at an axially upper region of the crushing shell at or above an upper contact surface intended to be positioned in direct contact with either the intermediate spacer ring or the inward facing surface of the topshell. The shoulder is configured to support the sealing ring and provide an abutment stop that is effective to act against the downward force on top of the sealing ring resultant from the accumulation of fines and debris materials. Accordingly, the present sealing ring is adapted to compress axially and to try and expand radially outward within the cavity region immediately above the crushing shell shoulder to maintain and optimise the seal strength. Accordingly, the present crushing shell and sealing ring arrangement is effective to prevent axially downward ingress of rock dust and particles between the contact surfaces of the crushing shell, sealing ring and/or topshell wall.

The shoulder may be formed at the wall of the shell as a single annular flange being continuous or discontinuous circumferentially around the outward facing surface of the shell. Additionally, the shoulder may represent a lower part of a groove indented within the wall of the shell, the groove extending radially inward from the outward facing mount surface. When formed as a groove, the abutment face of the shoulder represents a lowermost surface that defines the groove being positioned opposed to an uppermost surface that defines the groove. A trough surface extends between the opposed lowermost and uppermost faces such that the sealing ring is accommodated within the groove in contact with the inward facing surfaces that define the groove. The groove configuration is advantageous to inhibit axial movement of the sealing ring in both upward and downward directions.

According to a first aspect of the present invention there is provided a gyratory crusher outer crushing shell mountable within a region of a topshell of a gyratory crusher and extending around a longitudinal axis, the crushing shell comprising: a mount face being outward facing relative to the axis for positioning opposed to a least a part of the topshell and a crushing face being inward facing relative to the axis to contact material to be crushed, a wall defined by and extending radially between the mount surface and the crushing surface, the wall having a first upper axial end and a second lower axial end; a raised first contact region positioned axially towards the first upper axial end and extending radially outward at the mount surface and in a direction around the axis, the contact region having a radially outward facing raised first contact surface for positioning opposed to a radially inward facing surface of the topshell or an intermediate spacer ring; a raised second contact region positioned axially towards the second lower axial end and extending radially outward at the mount surface in a direction around the axis, the second contact region having a radially outward facing raised second contact surface for positioning opposed to a radially inward facing surface of the topshell; characterised by: a ledge or groove provided at the mount face side of the wall at a position of the raised first contact region or axially between the first upper axial end and the raised first contact region, the ledge or groove providing an abutment face to seat a sealing ring positionable between the mount face and the topshell or spacer ring, a radial length of the abutment face being less than a radial thickness of the wall at the region between the first upper axial end and the raised first contact region.

Preferably, the ledge or groove extends continuously in a direction around the axis or is discontinuous around the axis. Optionally, the abutment face extends substantially perpendicular or traverse to the axis to provide a secure seat for the ring. Optionally, a region of the mount face immediately axially above the ledge or groove extends substantially perpendicular to the abutment face. Optionally, a region of the mount face immediately axially above the ledge or groove extends substantially parallel to the axis. Such configurations are advantageous to provide a strong seal at the region between the ring and the crushing shell.

According to one embodiment, the raised first contact surface is positioned radially outward beyond the ledge or groove and the abutment face. Accordingly, the ledge and ring do not interfere with the mating of the crushing shell at the topshell or intermediate spacer ring. Optionally, a radial length of the abutment face is less than a radial thickness of the wall at a position immediately axially above the ledge or groove. As such the ledge does not change, to any significant degree, the physical and mechanical properties of the crushing shell that is optimised for cooperation with the inner shell to act on the material passing through the crushing zone. Optionally, a radial length of the abutment face is in a range 5 to 50% of the thickness of the wall at a position immediately axially above the ledge or groove. Optionally, a radial length of the abutment face is less than 80% of the thickness of the wall at a position immediately axially above the ledge or groove. Accordingly, a radial length of the abutment face at the ledge or groove is less than a radial thickness of the wall at the raised upper contact region. That is, the radial length of the ledge (or abutment face) is sufficient only to prevent the axially downward movement of the ring.

Optionally, the shoulder or groove may be positioned between an upper end of the crushing shell and the upper contact surface. According to a one embodiment, the abutment face may be positioned at an axial position between the first upper end and the raised first contact surface so as to optimise the seal with regard to increasing the seal strength and to provide a shallower or deeper trough into which dust debris and particles accumulate above the sealing ring. As will be appreciated, the greater volume of material accumulated above the sealing ring, the greater the sealing strength between the crushing shell and the intermediate spacer ring or topshell. In one embodiment the groove or ledge is positioned at an axially upper section of the raised first contact region so as to prevent the axially downward passage of debris and particles to and beyond the first contact surface.

According to a second aspect of the present invention there is provided a gyratory crusher outer crushing shell assembly mountable within a region of a topshell of a gyratory crusher, the assembly comprising: an outer crushing shell as claimed herein; a sealing ring seated at the abutment face and extending in contact with and around the shell, the ring prevented from passing axially downward towards the raised first contact region via abutment with the abutment face.

The mounting of the sealing ring at the axially upper region of the concave is further advantageous to provide automatic centring of the concave within the topshell as the topshell is lowered into position during assembly. In particular, as the sealing ring projects radially from the concave upper region, it is capable of contacting the inner wall of the topshell during downward movement such that the concave is forced reliably and conveniently to a true axial centre by radial deflections of the sealing ring. Accordingly, the need for additional centring steps and specific tools is therefore avoided and the downtime of the crusher reduced.

Optionally, the sealing ring comprises a main body to seat at the abutment face and to extend radially outward beyond the ledge or groove to contact the topshell or the radially intermediate spacer ring.

Optionally, the sealing ring comprises a main body to seat at the abutment face and at least one flange projecting radially outward from the main body to contact the topshell or the radially intermediate spacer ring. Preferably, the at least one flange extends at an upwardly inclined angle from the main body. Preferably, the assembly of the sealing ring comprises at least two flanges projecting radially outward from the main body at upwardly inclined angles from the main body. Optionally, the sealing ring may comprise a single flange extending radially outward from what may be considered a main body positioned and supported by the annular shoulder.

Preferably, the sealing ring comprises a plurality of ribs projecting radially inward from the main body to contact the mount face at the region immediately axially above the ledge or groove. Optionally, the sealing ring may comprise a single annular rib projecting radially inward from what may be considered the main body in contact with the annular shoulder.

Optionally, the assembly further comprises a spacer ring positioned radially outward of the shell, the sealing ring positioned radially intermediate between the shell and the spacer ring.

According to a third aspect of the present invention there is provided a gyratory crusher comprising an outer crushing shell as claimed herein or an outer crushing shell assembly as claimed herein.

According to a fourth aspect of the present invention there is provided an annular sealing ring for a gyratory crusher mountable between an outer crushing shell and a topshell or intermediate spacer ring, the sealing ring comprising: a main body extending around a longitudinal axis; at least one flange projecting radially outward from the main body to contact the topshell or the radially intermediate spacer ring; at least one rib projecting radially inward from the main body to contact a radially outward facing surface of the crushing shell.

Preferably, at least a part of the at least one flange extends at an upwardly inclined angle from the main body relative to the axis.

Optionally, the sealing ring or a main body of the sealing ring comprises a rectangular, square, oval, circular, O-shaped, C-shaped, D-shaped, E-shaped or I-shaped cross sectional profile. Optionally, the sealing ring comprises a rubber material. Optionally, the rubber comprises a natural or synthetic rubber. Optionally, the sealing ring comprises a polyurethane or a polyurethane derivative material. Optionally the sealing ring comprises a having a Shore A hardness in the range between 35 to 90. Optionally, the sealing comprises a Shore A hardness in the range between 60 to 70 or more preferably 62 to 68. Such configurations enable the ring to compress radially outward to increase the seal strength between the crushing shell and the topshell or spacer ring.

Preferably, a radial length by which the at least one flange extends from the main body is greater or approximately equal to a radial length of the main body. Preferably, a radial length of the at least one rib is less than a radial length of the main body. Preferably, the sealing ring comprises two flanges and a plurality of ribs.

Optionally, the sealing ring or ring main body is hollow. Optionally, the sealing ring or ring main body is substantially solid. Optionally, where the sealing ring or ring main body is substantially solid, it may comprise internal cavities or voids to provide an internal 'open' structure that allows the ring (and main body) to compress with a desired compression characteristic radially and/or axially between the crushing shell and topshell or spacer ring. Optionally, the sealing ring comprises a resiliently deformable material.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
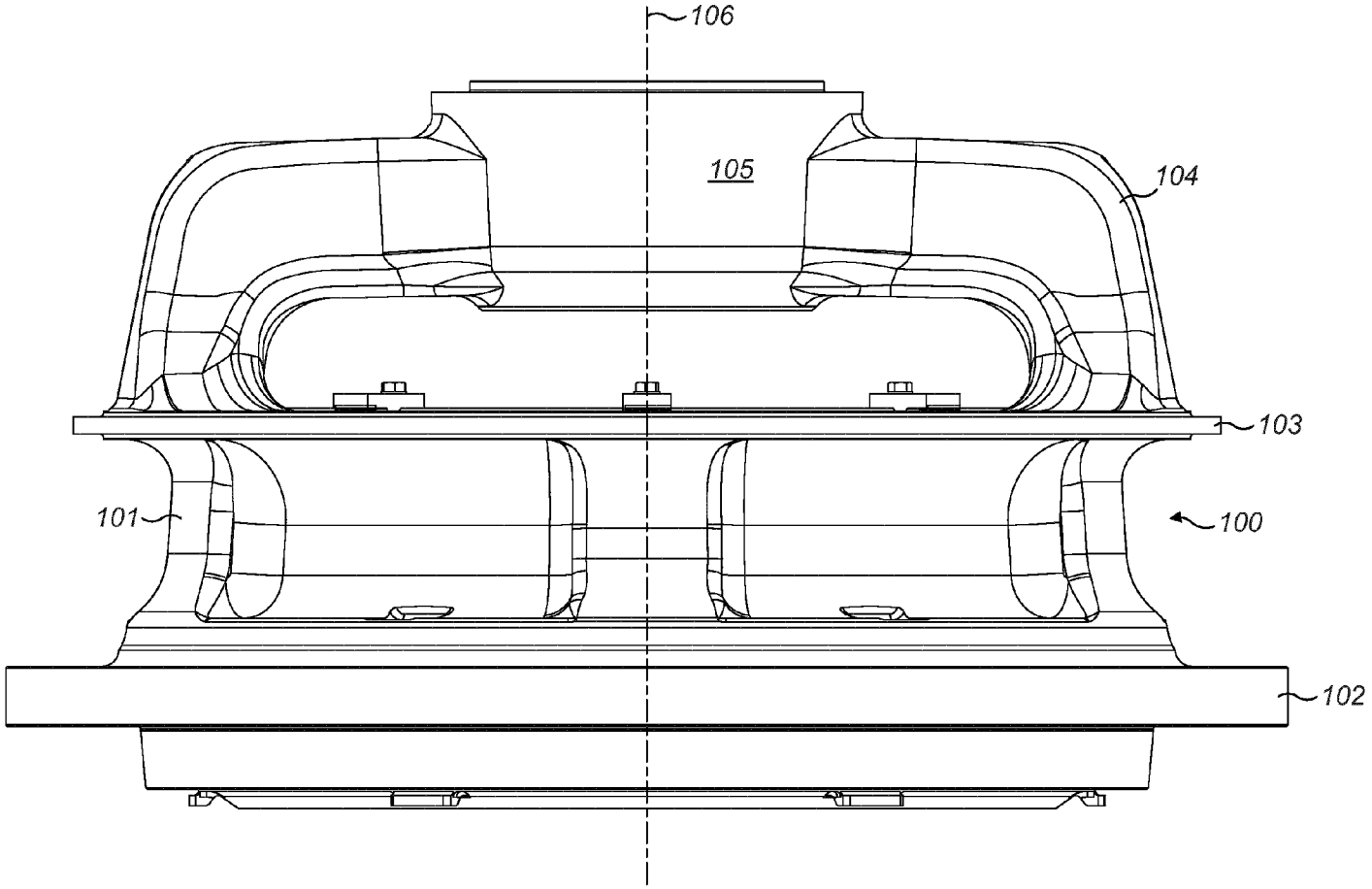
FIG. 1 is an external side elevation view of a topshell frame part of a gyratory crusher according to a specific implementation of the present invention.
Figure 2:
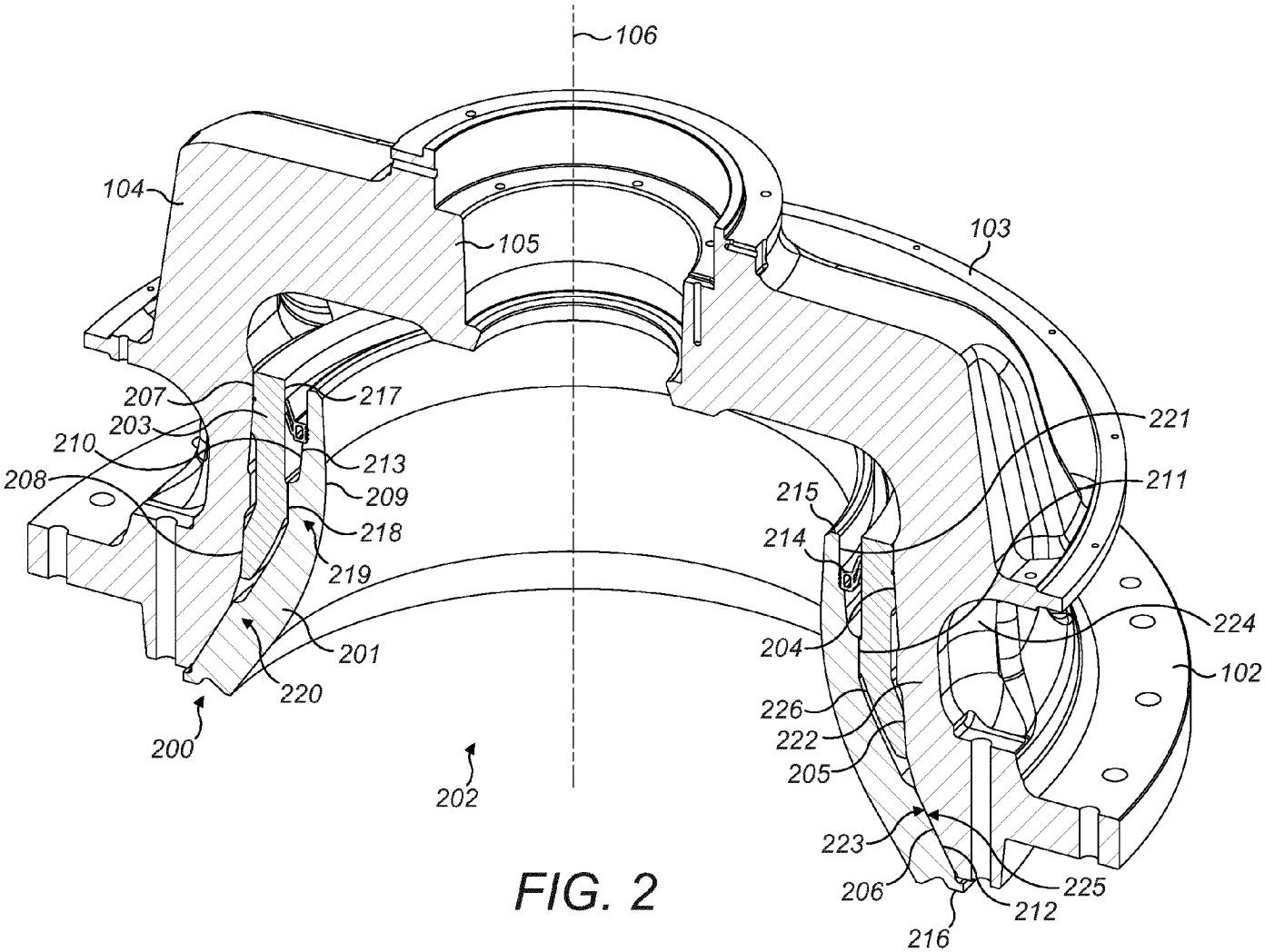
FIG. 2 is a cross sectional perspective view of the crusher frame part of FIG. 1 in which an outer crushing shell and an intermediate spacer ring are housed within an internal crushing chamber.

Referring to FIGS. 1 and 2, a gyratory crusher comprises a frame comprising a topshell 100 forming an upper part of the crusher and mountable upon a bottom shell (not shown) such that the topshell 100 and bottom shell together define an internal chamber. A crushing head (not shown) is mounted on an elongate main shaft (not shown) extending through the crusher in the direction of longitudinal axis 106. A drive (not shown) is coupled to the main shaft and is configured to rotate eccentrically about axis 106 via a suitable gearing (not shown) to cause the crushing head to perform a gyratory pendulum movement and to crush material introduced into the crushing chamber. An upper end region of the main shaft is maintained in an axially rotatable position by a top-end bearing assembly (not shown) accommodated within a central boss 105. Similarly, a bottom end of the main shaft is supported by a bottom-end bearing assembly (not shown) accommodated below the bottom shell.

Topshell 100 is divided into a chamber wall region 101 extending axially between an upper annular rim 103 and a lower annular rim 102 secured to the bottom shell. A spider forms an upper region of topshell 100 and is positioned axially above rim 103. The spider comprises a pair of spider arms 104 that project radially outward from central boss 105 to terminate at their radially outermost end at rim 103.

Topshell wall region 101 comprises topshell walls 222 defined between a radially inward facing surface indicated generally by reference 223 and a radially outward facing surface 224 relative to axis 106. Inward facing surface 223 defines an internal chamber 202 through which material to be crushed is fed via an input hopper (not shown) mounted generally above topshell 100 via rim 103.

Figure 3:
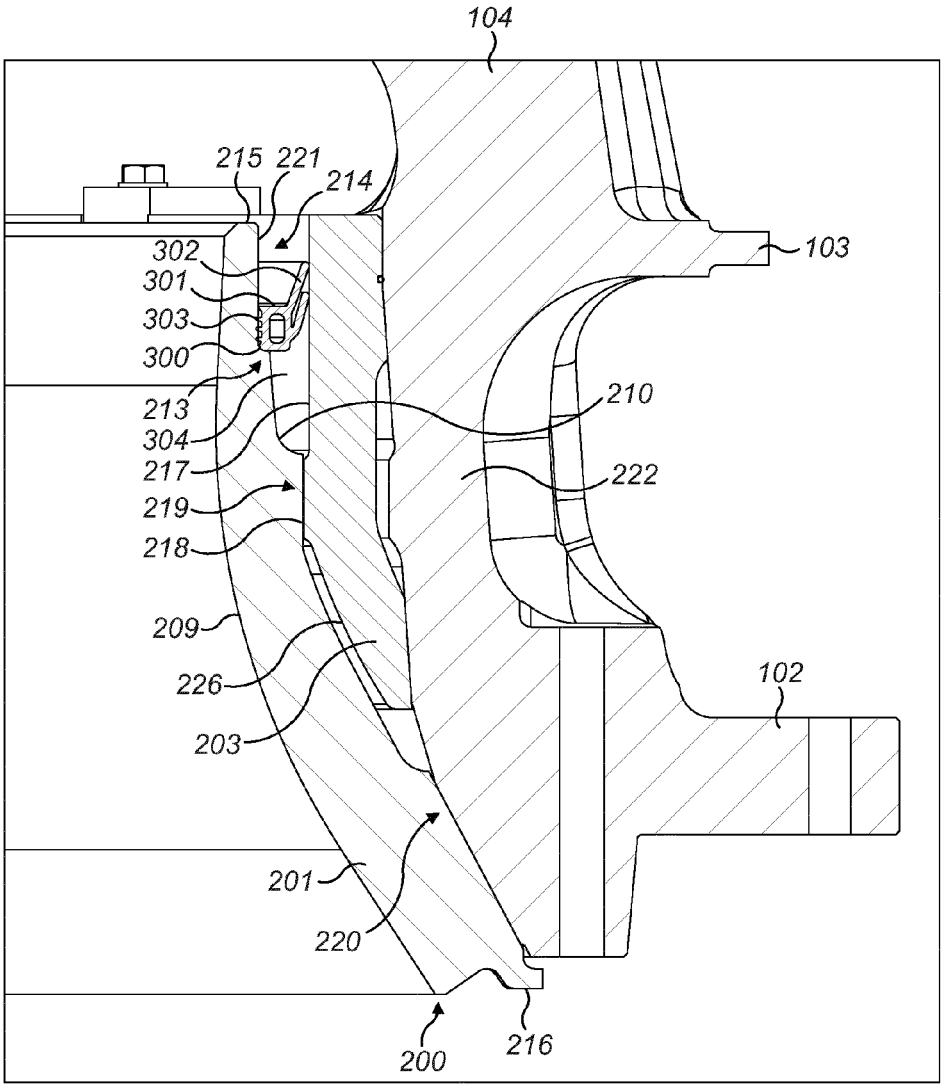
FIG. 3 is a cross sectional side view through the wall region of the topshell frame part of FIG. 2.

As illustrated in FIGS. 2 and 3, an outer crushing shell 200 is accommodated within chamber 202. Shell 200 extends circumferentially around axis 106 and comprises an inward facing crushing surface 209 and an opposed radially outward facing mount face indicated generally by reference 225 to define a wall 201 having a generally concave configuration at the region of the outward facing face 225. Wall 201 comprises a first annular upper end 215 and a second and lower annular end 216. Wall 201 is divided into a plurality of regions in the axial direction 106 in which a raised first (upper) contact region 219 is axially separated from a raised second (lower) contact region 220. The regions 219, 220 are separated by an axially intermediate groove 600 (referring to FIG. 6). Region 219 is positioned in an axially upper half of shell 200 and region 220 is positioned in an axially lower half of shell 200. Upper contact region 219 comprises a radially outward facing contact surface 211 aligned substantially parallel with axis 106. Lower contact region 220 also comprises a radially outward facing contact surface 212 orientated transverse and inclined relative to axis 106. According to further embodiments, outward facing contact surface 211 may be aligned transverse to axis 106 so as to be inclined at an angle or approximately 45° with an upper annular edge of surface 211 positioned closer to axis 106 than a corresponding lower annular edge.

Inward facing surface 223 of topshell wall region 101 is divided axially into a plurality of annular regions in the axial direction. A first mount region 204 is positioned axially uppermost towards rim 103. A second mount region is positioned axially lower than region 204 and towards rim 102. Second (lower) mount region is divided into an intermediate mount region 205 and a lowermost mount region 206 with intermediate region 205 positioned axially between upper and lowermost regions 204, 206.

Crushing shell 200 is positioned in direct contact against topshell 100 via mating contact between lower contact surface 212 and the radially inward facing surface of the lowermost mount region 206. Due to the function and geometry of crushing shell 200 an intermediate spacer ring 203 is positioned radially between an upper region of shell 200 and topshell 100. In particular, spacer ring 203 comprises a radially outward facing surface having a first upper mount surface 207 and a corresponding second lower mount surface 208. Upper surface 207 is positioned in direct contact with topshell region 204 whilst the second lower mount surface 208 is positioned in direct contact with the intermediate mount region 205. Spacer ring 203 comprises a radially inward facing surface axially divided into an upper region 217, a lower region 226 and an intermediate region 218. Intermediate region 218 is formed as an annular shoulder projecting radially inward relative to upper and lower regions 217, 226. According to the present implementation, the radially inward facing surface at shoulder region 218 is positioned in direct contact with the radially outward facing upper contact surface 211. Accordingly, spacer ring 203 is positioned radially intermediate the upper region of shell 200 and topshell wall 222. An annular cavity 304 extends circumferentially around axis 106 between the opposed radially outward facing surface of shell 200 at an upper region 221 (immediately below upper end 215) and the radially inward facing surface at the upper region 217 of spacer ring 203. An intermediate sealing ring indicated generally by reference 214 is positioned radially intermediate spacer ring 203 and shell 200 within cavity region 304.

According to the specific implementation, sealing ring 214 comprises a generally annular configuration extending around axis 106. A main body 301 comprises a cross sectional O-shaped profile. A pair of flanges 302 project radially outward from main body 301 at an upwardly inclined angle from an outward facing side of main body 301. A plurality of ribs 303 project radially inward from an opposed inner facing side of main body 301. When located within cavity 304, ribs 303 are positioned in contact with the radially outward facing face 225 of crushing shell 200 at upper region 221 and flanges 302 are positioned in contact with the radially inward facing surface of the spacer ring 203 at upper region 217.

To provide an axial lock for sealing ring 214, crushing shell 200 comprises an annular ledge 213 formed as a shoulder projecting radially outward from an upper region of wall 201. Accordingly, an abutment face 300 is defined by ledge 213 and extends substantially perpendicular to axis 106 and in particular the substantially cylindrical outward facing surface of shell 200 at upper region 221. That is, abutment face 300 terminates at its radially innermost end by the surface of upper region 221 and is terminated at its radially outermost end by the surface of lower region 210 that is aligned transverse to the surface of upper region 221 and axis 106. According to the specific implementation, a radial length of abutment face 300 is less than a thickness of wall 201 immediately below upper end 215 as defined between the inward 209 and outward 225 facing surfaces at this upper region 221. Ledge 213 is positioned axially between upper end 215 and the raised first contact region 219.

Figure 4:
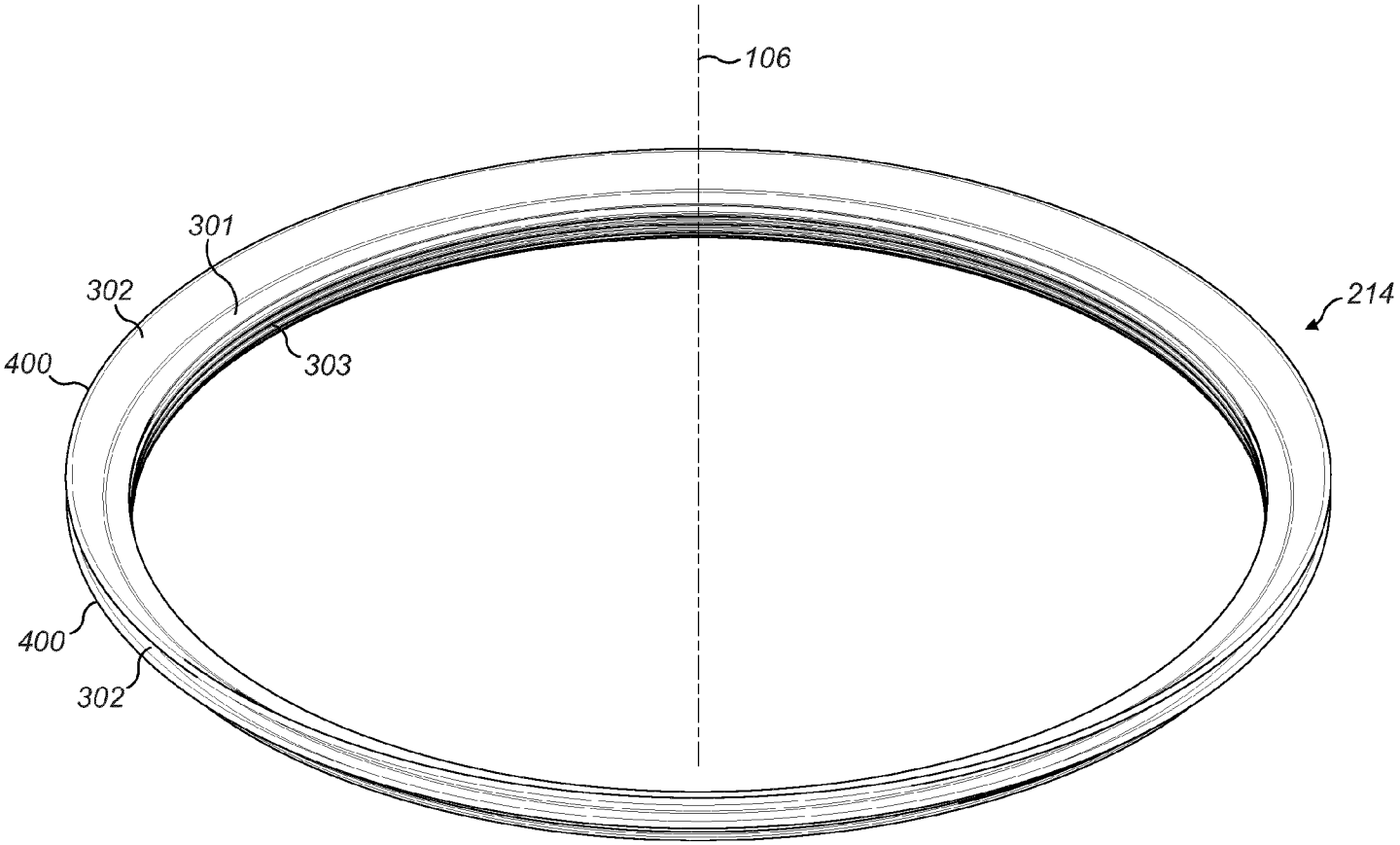
FIG. 4 is a perspective view of a sealing ring for positioning between the outer crushing shell and either the intermediate spacer ring or topshell wall.
Figure 5:
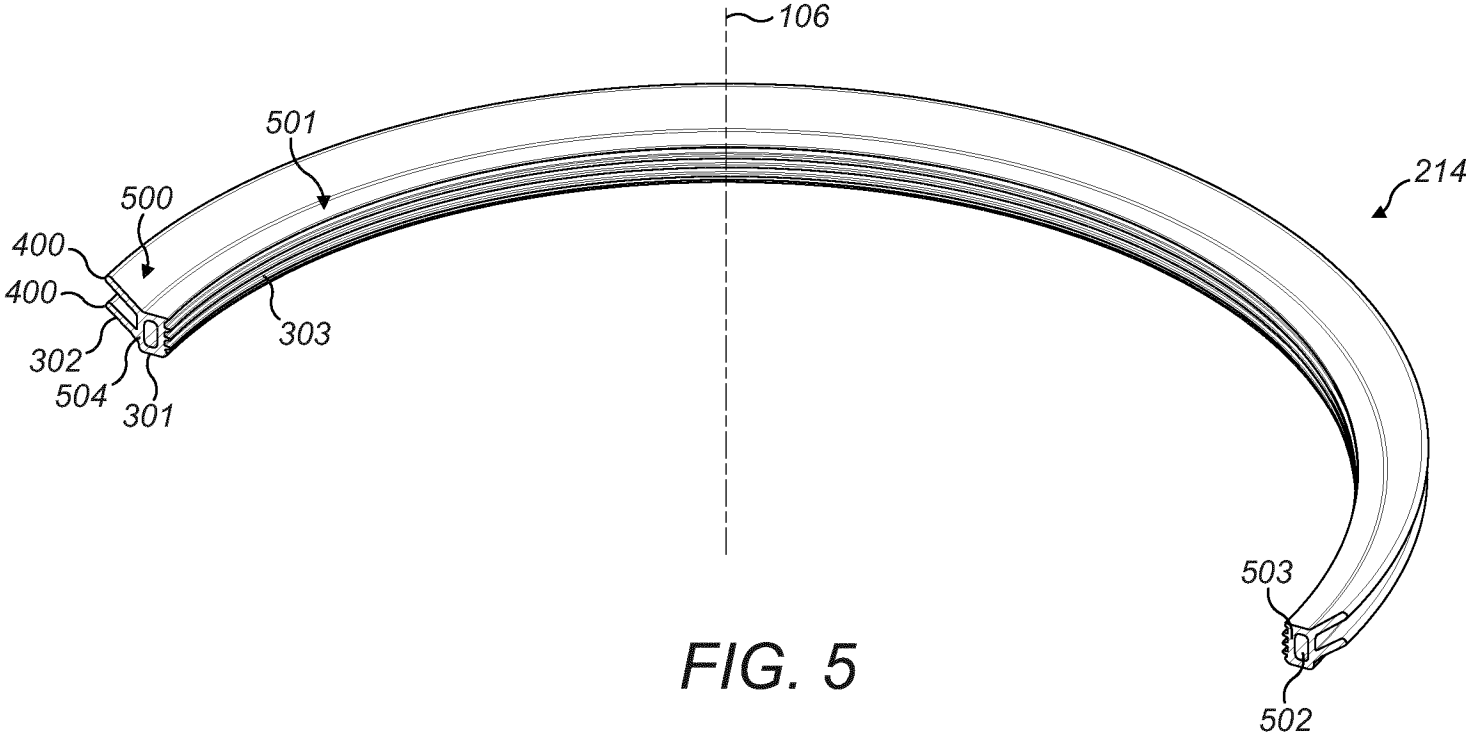
FIG. 5 is a perspective cross sectional view of the spacer ring of FIG. 4.

Referring to FIGS. 3 to 5, each flange 302 of sealing ring 214 is inclined upwardly from main body 301 and project from a radially outward facing wall 504 of main body 301. Each flange 302 is terminated at its radially outer end by an annular circumferentially extending tip 400 configured for positioning in direct contact against surface 204 of topshell wall 222 or surface at region 217 of spacer ring 203. Each flange 302 is substantially elongate in a radial direction from axis 106 and comprises an approximate radial length being equal to or slightly greater than a corresponding radial length of main body 301. One flange 302 extends from an axially upper region of main body 301 whilst a second lower flange 302 extends from an axially lower region of main body 301 such that a spatial gap is provided between the inclined flanges 302 extending substantially parallel to one another from main body 301.

Ribs 303 project radially inward from a radially inner side 503 of main body 301. The radial length of ribs 303 is much less than the corresponding radial length of flanges 302. In particular, a radial length of ribs 303 is approximately equal to the thickness of inner wall 503 of main body 301. Ribs 303 as illustrated in FIGS. 2 and 3 are configured for positioning in direct contact with the radially outward facing surface 225 of shell 200 at region 221. According to the specific implementation, an annular chamber 502 extends within main body 301 being defined, in part, by side walls 503, 504.

According to further specific implementations, main body 301 may comprise alternate configurations including for example and I-shaped cross sectional profile with flanges 302 extending from a first side and ribs 303 extending from a second side.

An upper face of ring 214 may be divided radially into a radially inner annular face 501 and radially outer annular face 500. Face 501 is defined by an upper end of main body 301 and face 500 is defined by an upper face of the uppermost flange 302. Accordingly, face 500 is inclined upwardly relative to face 501 that is aligned approximately perpendicular to axis 106. Accordingly, faces 500 and 501 in combination with the inward facing surface of the spacer ring 203 at region 204 and the outward facing surface 225 of crushing shell 200 at region 221 define an annular trough into which debris crushing material is collected to press axially downward onto sealing ring 214.

As will be appreciated, the present shell 200 is compatible and intended for use with a range of sealing ring shapes and configurations not restricted to a seal having a main body and at least one radially extending flange. In particular, the present shell 200 and topshell assembly may comprise a sealing ring formed by a more 'conventional' construction being either a solid or hollow body having a rectangular, square, circular or oval cross sectional profile. According to further embodiments, the cross section profile may be O-shaped, C-shaped, D-shaped, E-shaped or I-shaped. In particular, and according to a preferred embodiment, the sealing ring may comprise any one of these cross sectional shape profiles and does not comprise a radially extending flange.

Figure 6:
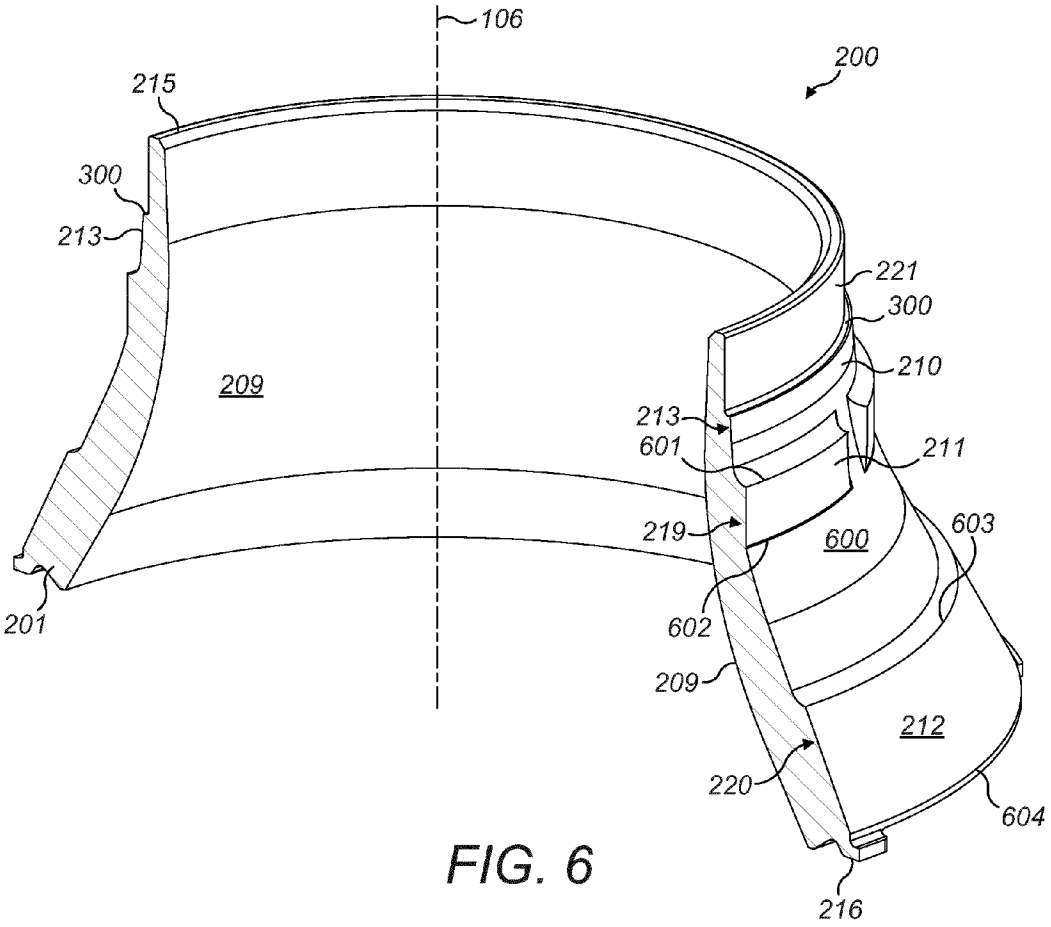
FIG. 6 is a cross sectional perspective view of the outer crushing shell of FIG. 3.

Referring to FIG. 6, upper contact surface 211 of shell 200 comprises an upper edge 601 positioned towards upper end 215 and a lower edge 602 positioned axially towards lower end 216. Similarly, the outward facing surface 212 at the lower and second raised contact region 220 is defined by an upper edge 603 and a lower edge 604 relative to upper and lower ends 215, 216. Upper and lower contact surfaces 211, 212 are separated axially by groove 600 that extends between the corresponding lower 602 and upper 603 edges of the respective faces 211, 212. According to the specific implementation, shoulder 213 and in particular abutment face 300 is positioned approximately mid-way between upper edge 601 and upper end 215.

In use, sealing ring 214 is configured to prevent dust and debris particles from passing downwardly beyond cavity 304 and between the mating surfaces 218, 211 of the intermediate spacer ring 203 and crushing shell 200 respectively. Advantageously, the present sealing ring 214 is configured to be both self-sealing to provide a seal strength between the opposed spacer ring 203 and shell 200 that increases as more debris and particles collect on top off ring 214 from within the crushing zone 202. That is, as material is crushed within zone 202, particulates and 'fines' settle into the upper region of cavity 304 directly on top of ring 214 and in contact with uppermost surface of the ring 214 (i.e., surfaces 500, 501 referring to the embodiment of FIGS. 4 to 5). The accumulation of material above ring 214 compresses the ring (and/or flanges 302) axially downward to press against the surface at region 217 (optionally via tips 400). Additionally, main body 301 is compressed axially downward such that the ring 214 (and optionally ribs 303) are forced radially outward in contact with region 221. The particulate contaminants are thereby prevented from passing axially beyond ring 214 into the lower region of cavity 304 defined by the opposed faces at regions 210, 217. Ring 214 is securely held in the axial position by ledge 213 and abutment face 300 that contacts the underside of ring 214.

FIGS. 2, 3 and 6 illustrate a specific embodiment of the present invention in which crushing shell 200 may be regarded as medium coarse. A further embodiment is illustrated with reference to FIGS. 7 and 8 that may be regarded as a medium grade crushing shell. As will be noted, this particular crushing shell configuration does not require the intermediate spacer ring 203 positioned radially between the crushing shell 200 and topshell wall 222. Additionally, FIG. 7 illustrates an alternative embodiment of sealing ring 214 comprising a generally rectangular cross sectional profile and having a substantially solid main body being devoid of radial flanges and ribs.

Figure 7:
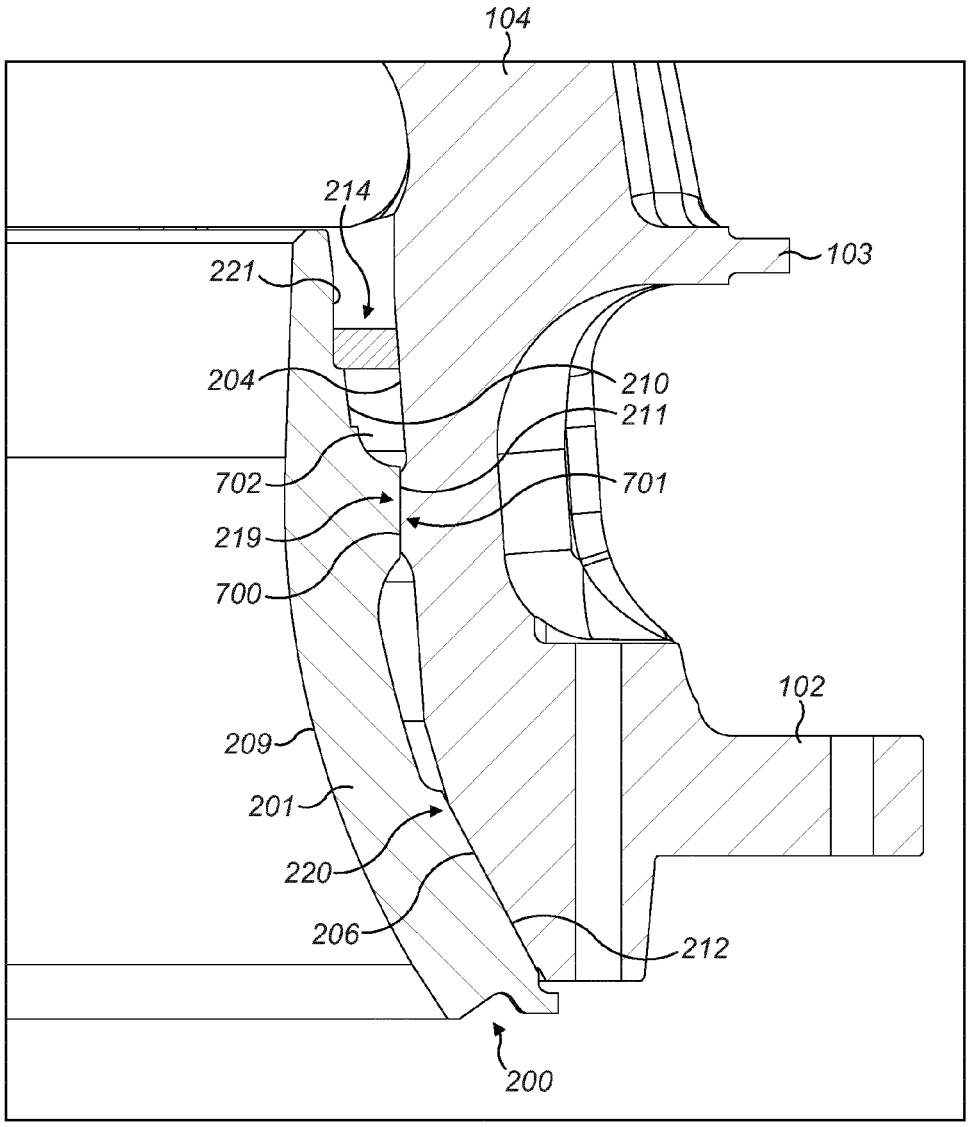
FIG. 7 is a cross sectional side view of a further embodiment of the present invention in which the outer crushing shell is positioned in direct contact with the topshell wall above an upper and lower mount position.
Figure 8:
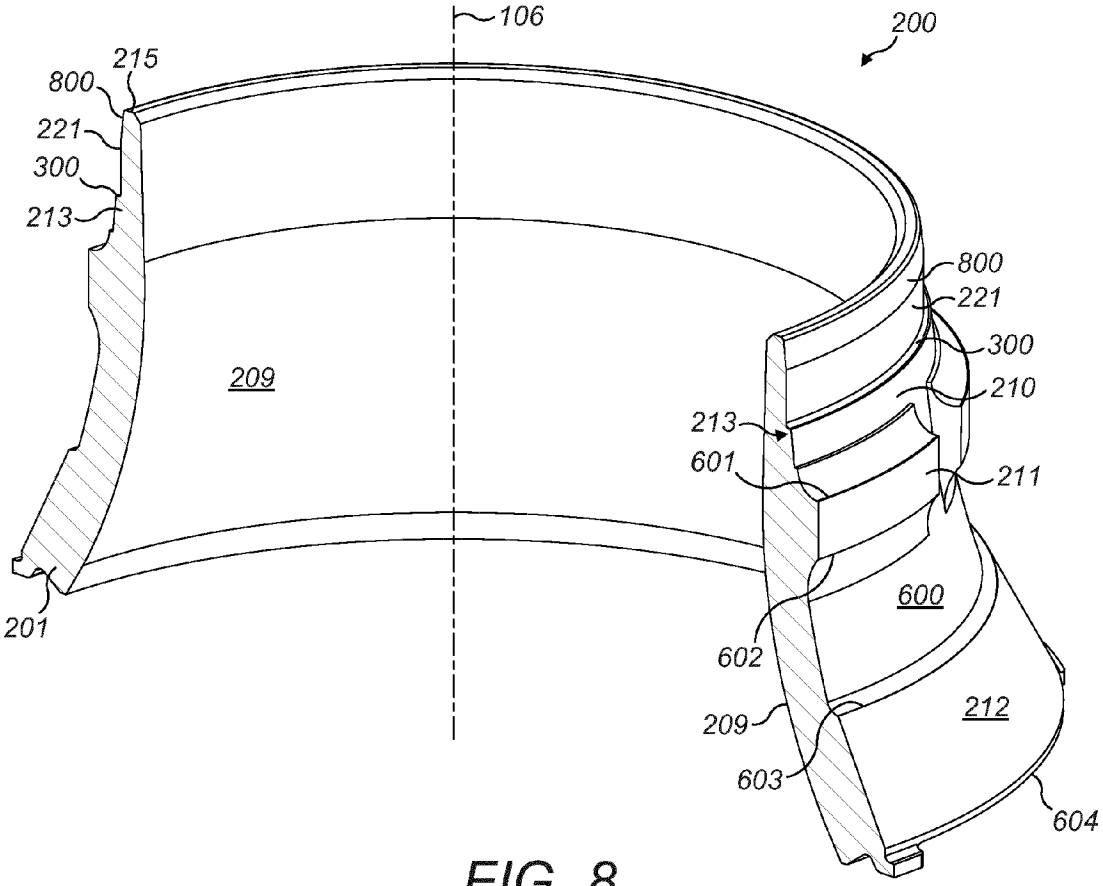
FIG. 8 is a cross sectional perspective view of the outer crushing shell of FIG. 7 according to the further embodiment of the present invention.

In particular and referring to FIGS. 7 and 8, the medium grade shell 200 is positioned in direct contact with topshell 100 at both the raised upper and lower contact regions 219, 220, respectively. That is, lower contact surface 212 is positioned in contact with the inward facing surface at lowermost mount region 206 whilst the upper contact surface 211 is positioned against and in contact with an inward facing surface 700 extending over an annular rib 701 that projects radially inward from topshell wall 222. As with the medium coarse configuration of FIGS. 2, 3 and 6, intermediate sealing ring 214 is accommodated within an annular cavity 702 defined between the outward facing surface of shell 200 at the upper regions 221, 210 and the inward facing surface at the upper mount region 204. As will be noted, the crushing shell 200 of FIGS. 7 and 8 comprises a wall 201 having a generally greater radial thickness. However, unlike the first embodiment, the cylindrical surface at region 221 does not extend the full axial length from abutment face 300 to upper end 215. Referring to FIGS. 7 and 8, cylindrical surface region 221 is terminated at its upper end by an inwardly tapering surface region 800 that terminates at upper end 215. As will be noted, the crushing shell 200 of the further embodiment of FIGS. 7 and 8 comprise the identical shoulder 213 and abutment face 300. Accordingly, sealing ring 214 is configured for positioning in direct contact with the crushing shell (at an upper region) and either in direct contact with the inward facing surface 223 at region 204 of topshell wall 222 or the inward facing surface at region 217 of intermediate spacer ring 203. Additionally, in both configurations the sealing ring 214 is configured to provide a seal strength that is increased during operation of the crusher as particulates collect above the ring 214 and compress the ring 214 against surfaces 221 and 204.

Figure 9:
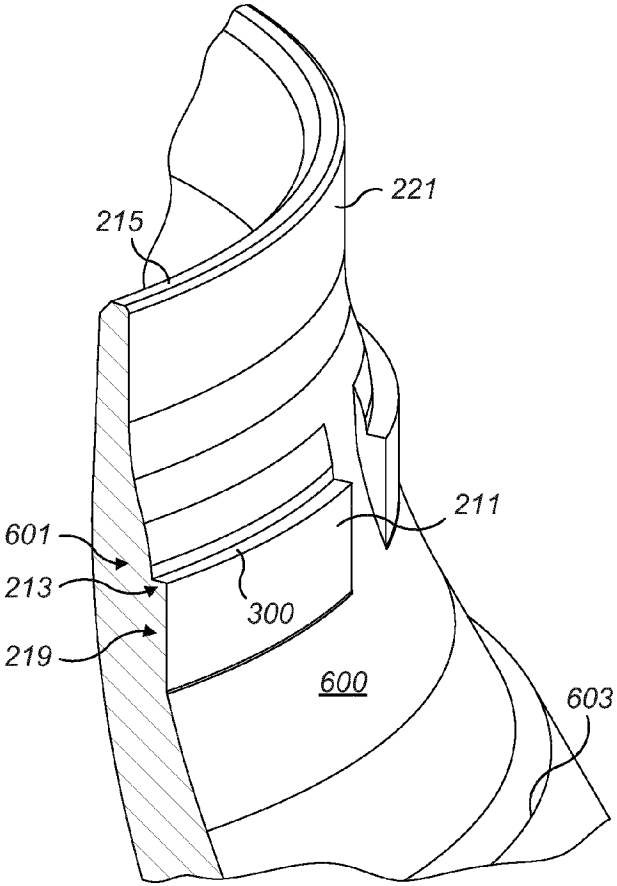
FIG. 9 is a cross sectional perspective view of an outer crushing shell according to a further specific implementation having a ledge positioned at an upper region of an upper contact surface.

A further embodiment is illustrated in FIG. 9 in which the annular shoulder 213 is positioned at the upper edge 601 of the raised first contact region 219. Accordingly, ledge 213 and a particular abutment face 300 is configured to seat ring 214 to prevent the downward passage of debris particles to the contact surface 211 where it may damage this region of the shell 200 and/or the topshell 100.

Figure 10:
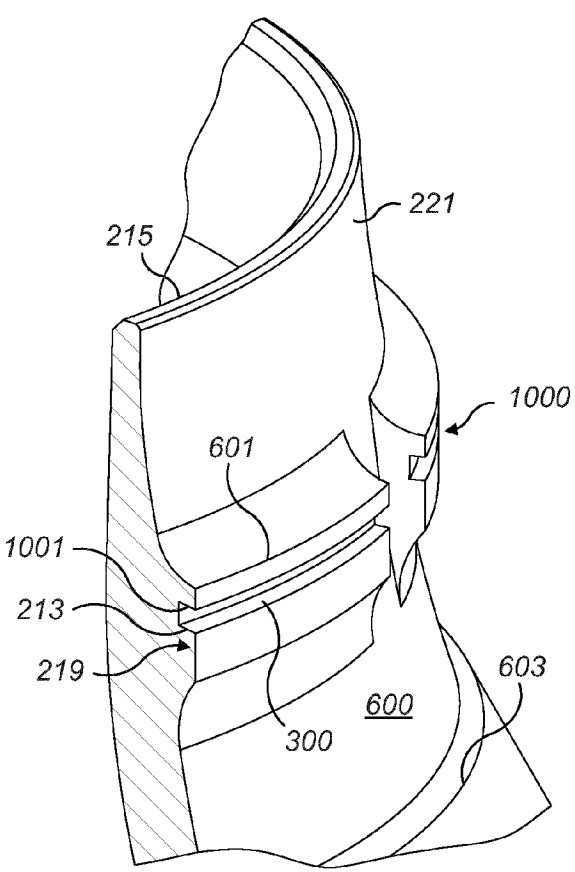
FIG. 10 is a cross sectional perspective view of an outer crushing shell having an annular groove formed within an upper contact region according to a further specific implementation of the present invention.

FIG. 10 illustrates a further embodiment in which ledge 213 is formed as a groove 1000 extending circumferentially around shell 100. Groove 1000 is recessed into the raised first contact region 219 so as to project radially inward from contact surface 211. Accordingly, the abutment face 300 represents a lower surface of the groove 1000 and is positioned opposed to an upper surface 1001 of the groove 1000. Accordingly, sealing ring 214 is positionable within groove 1000 so as to be held and secured between the opposed faces 300, 1001.

As will be noted from FIGS. 9 and 10, the raised first contact region 219 is discontinuous around axis 106 and hence the respective ledge 213 and groove 1000 is also discontinuous in the circumferential direction around axis 106. Additionally, a radial length of abutment face 300 is less than a thickness of wall 201 at the raised first contact region 219. That is, the ledge or groove has a radial length sufficient to seat the ring 214 only and does not reduce the structural integrity or strength of the shell wall 201.

According to further embodiments, groove 1000 may be embedded within upper region 221 a distance below upper end 215 at a position corresponding to the location of ledge 213 described with reference to FIG. 6.

According to the specific embodiment, sealing ring 214 comprises a rubber material having a Shore A hardness of between 35 to 90 and preferably substantially 65. Additionally, the ring 214 of FIGS. 2 to 5 and 7 may comprise a plurality (such as 2 to 8) axially spaced ribs 303 configured to provide a seal against a moderately rough contact surface at region 221. According to further embodiments, sealing ring 214 may comprise a single flange 302 or more than two flanges 302.

The invention claimed is:

1. A gyratory crusher outer crushing shell arranged to be mounted within a region of a topshell of a gyratory crusher and extending around a longitudinal axis, the crushing shell comprising:

a mount face being outward facing relative to the axis for positioning opposed to a least a part of the topshell and a crushing face being inward facing relative to the axis to contact material to be crushed, a wall defined by and extending radially between the mount face and the crushing face, the wall having a first upper axial end and a second lower axial end;

a raised first contact region positioned axially towards the first upper axial end and extending radially outward at the mount face and in a direction around the axis, the raised first contact region having a radially outward facing raised first contact surface for positioning opposed to a radially inward facing surface of the topshell or an intermediate spacer ring;

a raised second contact region positioned axially towards the second lower axial end and extending radially outward at the mount face in a direction around the axis, the raised second contact region having a radially outward facing raised second contact surface for positioning opposed to a radially inward facing surface of the topshell; and an abutment face arranged to seat a sealing ring positionable between the mount face and the topshell or spacer ring, a radial length of the abutment face being less than a radial thickness of the wall at the region between the first upper axial end and the raised first contact region, the abutment face being provided by and selected from a ledge or groove provided at the mount surface side of the wall at a position of the raised first contact region or axially between the first upper axial end and the raised first contact region.

2. The shell as claimed in claim 1, wherein the ledge or groove extends continuously in a direction around the axis.

3. The shell as claimed in claim 1, wherein the abutment face extends substantially perpendicular a transverse to the axis.

4. The shell as claimed in claim 1, wherein the ledge or groove is positioned axially between the first upper axial end and the raised first contact region.

5. The shell as claimed in claim 1, wherein the ledge or groove is positioned at an axially upper region of the raised first contact region.

6. The shell as claimed in claim 1, wherein the ledge is positioned radially outward at the mount face at a position axially between the first upper axial end and the raised first contact region.

7. The shell as claimed in claim 1, wherein a radial length of the abutment face is less than a radial thickness of the wall at a position immediately axially above the ledge or groove.

8. The shell as claimed in claim 1, wherein the ledge or groove is discontinuous around the axis.

9. A gyratory crusher outer crushing shell assembly mountable within a region of a topshell of a gyratory crusher and extending around a longitudinal axis, the assembly comprising:

an outer crushing shell including a mount face being outward facing relative to the axis for positioning opposed to a least a part of the topshell, a crushing face being inward facing relative to the axis to contact material to be crushed, a wall defined by and extending radially between the mount face and the crushing face, the wall having a first upper axial end and a second lower axial end, a raised first contact region positioned axially towards the first upper axial end and extending radially outward at the mount face and in a direction around the axis, the raised first contact region having a radially outward facing raised first contact surface for positioning opposed to a radially inward facing surface of the topshell or an intermediate spacer ring, a raised second contact region positioned axially towards the second lower axial end and extending radially outward at the mount face in a direction around the axis, the raised second contact region having a radially outward facing raised second contact surface for positioning opposed to a radially inward facing surface of the topshell, and an abutment face positionable between the mount face and the topshell or spacer ring, a radial length of the abutment face being less than a radial thickness of the wall at the region between the first upper axial end and the raised first contact region, the abutment face being provided by and selected from a ledge or groove provided at the mount face side of the wall at a position of the raised first contact region or axially between the first upper axial end and the raised first contact region; and a sealing ring seated at the abutment face and extending in contact with and around the shell, the ring being prevented from passing axially downward towards the raised first contact region via abutment with the abutment face.

10. The assembly as claimed in claim 9, wherein the sealing ring has a profile selected from any one of the set of a rectangular, square, oval, circular, O-shaped, C-shaped, D-shaped, E-shaped and I-shaped cross sectional profile.

11. The assembly as claimed in claim 9, wherein the sealing ring includes a plurality of ribs projecting radially inward to contact the mount face at the region immediately axially above the ledge or groove.

12. The assembly as claimed in claim 9, wherein the sealing ring has a substantially solid body.

13. The assembly as claimed in claim 9, wherein the sealing ring is made of a resiliently deformable material.

* * * * *